United States Patent [19]

Indra

[11] 4,074,668

[45] Feb. 21, 1978

[54] DISCHARGE VALVE FOR INJECTION PUMPS OF INTERNAL COMBUSTION ENGINES

[75] Inventor: Jaromir Indra, Brno, Czechoslovakia

[73] Assignee: Vysoke uceni technicke, Brno, Czechoslovakia

[21] Appl. No.: 656,651

[22] Filed: Feb. 9, 1976

[30] Foreign Application Priority Data

Feb. 14, 1975 Czechoslovakia ..... 969/75

[51] Int. Cl.[2] ..... F02M 59/02

[52] U.S. Cl. ..... 123/139 AF; 123/139 DP; 417/307

[58] Field of Search ..... 123/139 R, 139 AA, 139 AF, 123/139 AK, 139 AT, 139 BD, 139 DP; 417/307, 456, 490, 499, 501, 569

[56] References Cited

U.S. PATENT DOCUMENTS

| | | | |
|---|---|---|---|
| 2,090,351 | 8/1937 | Heinrich et al. | 417/569 X |
| 2,612,841 | 10/1952 | Lasley | 417/499 X |
| 2,918,048 | 12/1959 | Aldinger et al. | 417/307 X |
| 3,762,386 | 10/1973 | Vuaille | 123/139 AF X |

FOREIGN PATENT DOCUMENTS

| | | | |
|---|---|---|---|
| 902,199 | 1/1954 | Germany | 123/139 AT |
| 2,010,242 | 9/1971 | Germany | 417/499 |
| 2,348,865 | 4/1975 | Germany | 123/139 AF |
| 508,406 | 6/1939 | United Kingdom | 417/501 |

*Primary Examiner*—Carroll B. Dority, Jr.
*Assistant Examiner*—Tony M. Argenbright

[57] ABSTRACT

A piston-type injection pump for supplying fuel through a discharge conduit to an injector of an internal combustion engine. The injection pump has a relief piston movable between an upstream and a downstream position in a sleeve. This relief piston limits the rate of pressure drop in the discharge conduit. The sleeve has an annular groove and the relief piston is formed by at least one annular recess. A channel extends transversely through the relief piston at said annular groove. An axial blind channel terminates at said transverse channel. These two channels form part of the flow path for the fuel. The upper edge of either the annular groove or annular recess and the lower edge of the other define therebetween a maximum flow-through area for the fuel when the relief piston is in the upstream position. This maximum flow-through area is substantially equal to the cross-sectional flow-through area of the discharge conduit.

8 Claims, 4 Drawing Figures

図-2

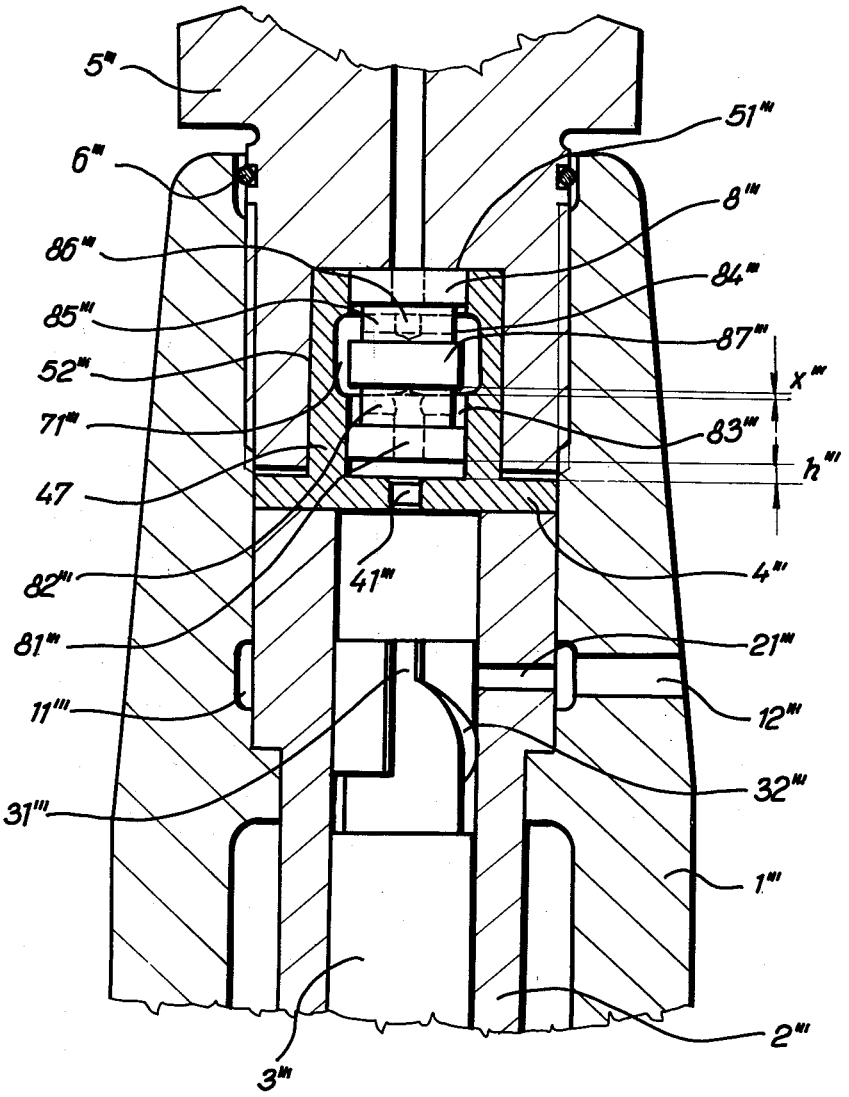
図-4

DISCHARGE VALVE FOR INJECTION PUMPS OF INTERNAL COMBUSTION ENGINES

CROSS-REFERENCE TO RELATED APPLICATION

This application is related to commonly assigned, co-pending application Ser. No. 649,358 filed Jan. 15, 1976.

BACKGROUND OF THE INVENTION

This invention relates to piston-type injection pumps adapted to supply fuel for internal combustion engines, for example, diesel engines. A discharge valve generally is mounted in a sleeve between the working space of the pump and a discharge conduit. The latter conduit has a variable expansion space, the maximum volume of which is smaller than the space delimited by the lower face of the discharge valve member and by a gasket in the extreme position of the discharge valve member most distant from the working space of the pump.

Injection pumps of this type having a discharge valve are already known. Such injection pumps have a prestressed spring which acts on the valve member. At the start of an actuating stroke by the pump piston, when the pump piston is beginning its guided motion, the prestress of a spring acting on the valve member is equal to zero and in the course of the pressure stroke the valve member is entrained due to the overpressure of fuel expanding from the discharge conduit of the injection pump, whereby the valve member does not come in contact with its seat even at the highest rotating speed and with the largest fuel doses. A drawback of such arrangements is the relatively high maintenance requirements; in addition, the spring is unduly long and becomes shorter after long periods of operation and, as a result, causes malfunctioning in the operation of such a valve. Such a spring also requires a certain space above the valve proper, which forms a dead space. The stroke of the valve member in the course of fuel discharge increases for higher revolutions of the injection pump causing undesirable inaccuracies in its operation.

SUMMARY OF THE INVENTION

The arrangement of this invention provides a discharge valve for injection pumps referred hereinabove which do not have the aforedescribed drawbacks. The stroke of the valve member of the discharge valve during discharge of fuel is limited so that a valve member, which functions as a relief piston, exposes only a cross-sectional flow-through area approximately equal to the cross-sectional area of the discharge conduit leading from the injection pump to the injector. Back pressure of the expanding fuel returns this relief piston to its starting position so that no springs are necessary.

According to this invention, a movable relief piston is guidingly mounted on a cylindrical surface of the discharge valve. This relief piston has at least one annular recess. In a first embodiment of the invention, the relief piston has a lower annular recess which is disposed near a gasket on the relief piston. At least one transverse channel is disposed at said lower recess and is in communication with a lower axial blind channel which communicates with the space between the lower face of the valve member and the gasket. This last-mentioned space is in communication with the working space of the injection pump via an opening in the gasket. The relief piston of the first embodiment also has an upper annular recess which is disposed close to an axial discharge channel of a connecting piece threadably mounted in the injection pump. This upper annular recess is connected with this discharge channel via at least a single transverse channel and an upper blind axial channel. The connecting piece has an axial semi-blind bore extending upwardly from its lower face in which a cylindrical sleeve, housing the valve member, is mounted. An annular groove is provided in the internal cylindrical wall of the sleeve and is disposed so that in the upper extreme position of the relief position, which is determined by the contact of its upper face with the upper end wall of the semi-blind bore in the connecting piece, the upper edge of the lower annular recess of the relief piston is situated above the lower edge of the annular groove in the wall of the sleeve. When the valve member with its relief piston is in the aforedescribed position, there is a cross-sectional flow-through area which is approximately equal to the cross-sectional flow-through area of the discharge conduit of the connecting piece. Simultaneously therewith, the upper edge of the annular groove in the wall of the sleeve is at least spaced the same distance above the lower edge of the upper annular recess of the valve member.

In the second embodiment of this invention the valve member or relief piston of the discharge valve is guided in the sleeve by its upper part only. An upper axial blind channel extends through this part and terminates at the place corresponding to the upper end of the relief piston. A transverse channel communicates the blind channel with the annular space defined by the annular groove in the sleeve.

The sleeve can be pressed or screwed into the semi-blind bore of the connecting piece. A clearance is provided between the lower end of the sleeve and the upper face of the gasket. The sleeve can also be freely inserted into the semi-blind bore of the connecting piece so that after tightening of the connecting piece the sleeve bears with its lower face against the upper face of the gasket. In such an arrangement, a clearance between the lower face of the connecting piece and the upper face of the gasket should be present. The sleeve and the gasket can also form a single unit which is freely insertable into the semi-blind bore of the connecting piece, provided a certain clearance remains between the lower face of the connecting piece and the upper face of an extended part of the unit forming simultaneously the sleeve and the gasket.

BRIEF DESCRIPTION OF THE DRAWING

The invention is further set forth in the following detailed description, taken in conjunction with the appended drawing, in which:

FIG. 4 is a partial schematic representation of a fourth embodiment of an injection pump for an internal combustion engine.

DETAILED DESCRIPTION

Figure 1:
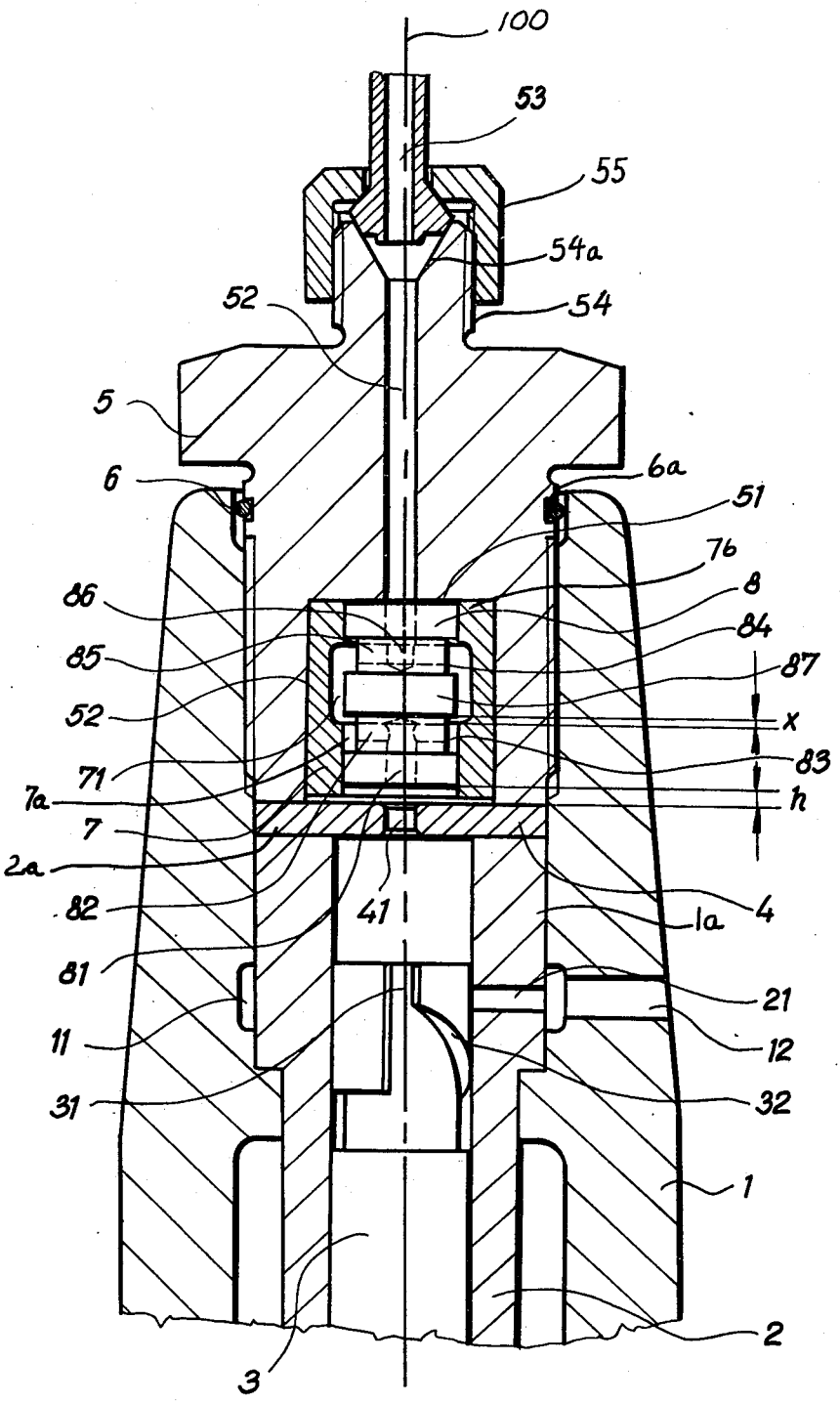
FIG. 1 is a mechanical schematic representation of a first embodiment of an injection pump for an internal combustion engine.

Referring now to FIG. 1, there is depicted an injection pump constructed in accordance with this invention. The upper portion of the pump piston 3 is provided with a longitudinal groove 31 and with an underlying recess, which cooperates to form a profiled regulating edge 32 of helical form. The piston 3 is supported for rotation about and for reciprocation along an axis 100 in a cylinder 2 having a radial channel 21 which communicates with a fuel chamber 11, into which fuel is supplied via a supply channel 12. The latter channel as well as the fuel chamber 10 are bored into a pump casing 1 having a bore 1*a* into which the pump cylinder 2 is tightly fitted. A gasket 4 having a central aperture 41 is mounted on the upper end face 2*a* of the pump cylinder 2. The upper portion of the bore 1*a* of the casing 1 is threaded and adapted to threadably receive a valve 5 therein. The valve 5 is provided with an annular recess 6*a* at its upper end in which a suitable ring gasket 6 is mounted thereby sealing the connection between the valve 5 and the casing 1. The channel 12, fuel chamber 11 and radial channel 21 serve for supplying fuel into the cylinder 2 from a conventional fuel source of an internal combustion engine. The piston 3 of the illustrated injection fuel pump is conventionally driven by the crankshaft of an internal combustion engine (not illustrated).

The valve 5 is provided with a threaded extension 54. A bore 52 extends from the end face 51 through the extension 54 and ends in a funnel-shaped cavity 54*a*. A cup-shaped connecting member 55 is threaded on the extension 54 and holds a flexible discharge member 53 in fluid communication with the funnel-shaped chamber 54*a* so that the fuel ejected from the fuel pump can be conducted via the discharge conduit 53 to a conventional injector (not illustrated) for the internal combustion engine.

The valve 5 has a bore 52 in which a sleeve 7 is tightly fitted. The sleeve 7 has an axial bore 7*a* and an annular groove 7*b* disposed in the bore 7*a*. A floating valve member 8 has an upper annular recess 84 and a lower annular recess 83 which form therebetween a relief piston 87. The valve member 8 furthermore has an upwardly extending blind axial channel 81 which terminates in a transverse radial channel 82. Furthermore, a downwardly extending blind channel 86 in the valve member 8 terminates in a transverse radial channel 85. The portion of the valve member 8 forming the relief piston 87 moves generally within the confines of the annular recess 71 so that fluid communication exists at all times between the upper and lower recesses 84 and 83 of the valve member 8.

The piston 3 is illustrated in FIG. 1 at the beginning of its upward motion, that is, at the beginning of the fuel discharging stroke. It can be noted that in this position the radial channel 21 is sealed by the helically-profiled cylindrical surface of the fuel injection piston 3, so that fuel is expelled from the space above the piston 3 via the central opening 41 of the gasket 4 into the space below the discharge valve member 8. The fuel pressure in the lower portion of the bore 7*a* urges the valve member 8 towards its uppermost position, that is, against the end wall 51. The compressed fuel flows via the lower blind axial conduit 81, the transverse radial conduit 82, the chamber formed by the annular recess 71, the upper transverse conduit 85 and the upper blind conduit 86 through the axial channel 52 into the discharge conduit 53, thereby passing dosed fuel from the pump to the injector of the internal combustion engine.

In FIG. 1 the valve member 8 is shown in its uppermost position so that the upper edge of the lower annular recess 83 is spaced above the lower edge of the annular groove 7*b* of the sleeve 7. The relative movement between the aforedescribed two edges exposes a through-flow cross-sectional area which is approximately equal to the cross-sectional area of the discharge conduit 53. The upper edge of the annular groove 7*b* of the sleeve 7 is spaced by at least the same distance above the lower edge of the upper annular recess 84. This distance between the aforementioned edges amounts, for small to medium-sized diesel engines, to only several thousandths of a millimeter, and is indicated by the reference numeral X in FIG. 1.

In the course of its upward movement, the piston 3 begins to expose, via the profiled regulating edge 32, the radial channel 21, thereby permitting the escape of fuel from the space above the piston 3 through the passage 31 into the space below the regulating edge 32 and through the radial passage 21 into the fuel chamber 11. As a consequence thereof, the fuel pressure in the space above the piston 3 drops rapidly and, due to back pressure emanating from the fuel discharge conduit 53, the fuel starts to flow from the discharge conduit 53 backwards towards the space above the piston 3. Due to this backward flow, the valve member 8 is entrained and is displaced downwardly the aforementioned distance X, thereby interrupting the direct communication between the discharge conduit 53 and the space above the piston 3. The expansion of the discharge fuel from the discharge conduit 53 causes the valve member 8 to be steadily moved toward the piston 3 and thereby the relief piston 87 of the valve member 8 approaches the cylindrical surface of the bore 7*a*. This condition continues until the fuel pressure in the discharge conduit 53 has dropped to a valve equaling the fuel pressure in the fuel chamber 11. This condition is reached, however, before the lower face of the valve member 8 makes contact against the upper face of the gasket 4, even at very high working speeds and with large injected fuel doses. This operating condition can be attained by precisely selecting the distance *h*, as illustrated in FIG. 1. It should therefore be noted that the lower face of the valve member 8 does not, under any operational circumstances, contact the upper face of the gasket 4. The aforedescribed constructional characteristics prevent sudden stoppages of fuel flow as well as pressure waves in the discharge conduit 53 which could cause excessive fuel fluctuations and injections.

The aforedescribed arrangement, operational characteristics and constructional details of the valve member 8 make possible the reduction of dead space above the valve member 8, thereby substantially contributing to an improved injection process.

The possibility of metallic shocks between the upper face of the discharge valve member 8 and the upper wall 51, which could cause a deformation of the upper wall 51, are virtually eliminated. This is due to the fact that the exposure of the through-flow cross-sectional area between the lower edge of the relief piston 87 and the lower edge of the annular recess 71 of the sleeve 7, which could occur due to a sudden upward movement of the valve member 8, is prevented because such upward motion is dampened by virtue of the fact that the fuel above the upper face of the valve member 8 has to be expelled into the discharge channel 52, which automatically forms a dampening cushion. Furthermore, this dampening is also due to the fact that the valve member 8 has a very small mass.

The aforedescribed valve construction is very simple, needs only small amounts of material and is cheap to manufacture. If the distance *h* is made sufficiently large, the same discharge valve member 8 can be used for several sizes of injection pumps and the manufacturing costs are therefore reduced even further.

Figure 2:
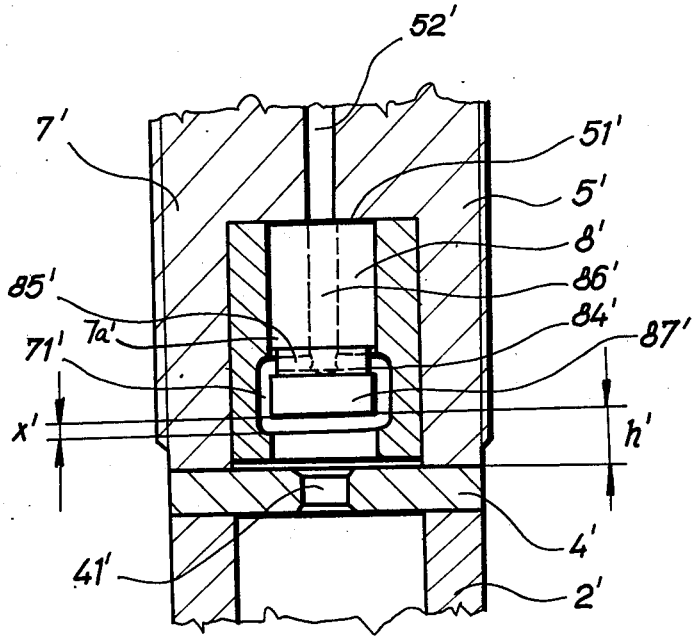
FIG. 2 is a partial schematic representation of a second embodiment of an injection pump for an internal combustion engine.

FIG. 2 illustrates schematically a second embodiment of the discharge valve for injection pumps of internal combustion engines which renders a similar effect as the discharge valve of FIG. 1. Those parts of the discharge valve of FIG. 2 which are equivalent to parts of the discharge valve of FIG. 1 have the same reference numerals with an added prime (′). The principal constructional difference between the discharge valves of FIGS. 1 and 2 resides in the configuration of the upper cylindrical part of the valve member 8′ situated above the relief piston 87′. It can be noted that this portion of the valve member 8′ is much longer than the equivalent portion of the valve member 8 which assures a sufficient guiding of the valve member 8′ in the bore 7*a*′. It can be noted that the cylindrical portions below the relief piston 87 of the embodiment of FIG. 1 are completely omitted in the embodiment of FIG. 2. The distances *x*′ and *h*′ of FIG. 2 can therefore not be completely analogized to the distances *x* and *h* of FIG. 1.

As has been stated with respect to the embodiment of FIG. 1, the sleeve 7′ can be directly pressed into or screwed into the valve piece 5′ so that a certain clearance is retained between the lower face of the sleeve 7″ and the upper face of the gasket 4′.

Figure 3:
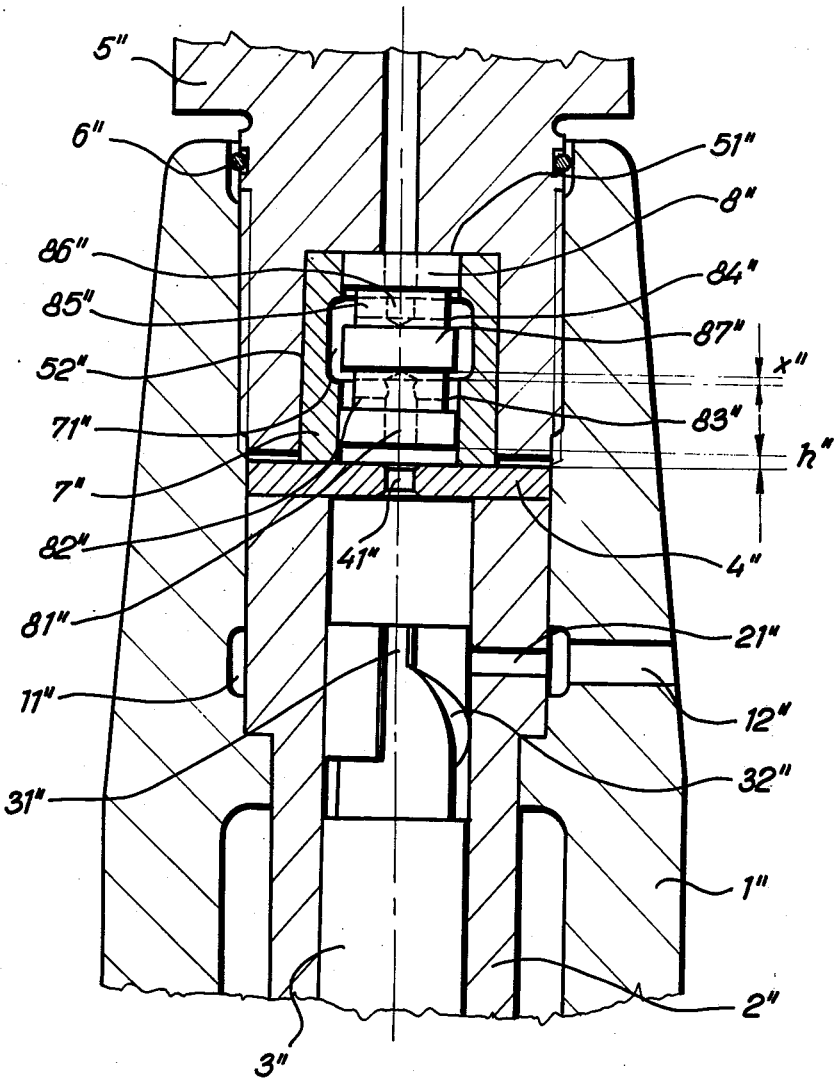
FIG. 3 is a partial schematic representation of a third embodiment of an injection pump for an internal combustion engine.

In a third embodiment of the invention illustrated in FIG. 3, the parts of the discharge valve that are equivalent to parts of the discharge valve of FIG. 1 have the same reference numerals but with an added double prime (″). The sleeve 7″ can be freely inserted into a mating bore of the valve member 5″. The valve member 5″ is threaded into the casing 1″ so that the lower face of sleeve 7″ abuts against the upper face of the gasket 4″ and a small clearance is provided between the lower face of the valve member 5″ and the upper face of the gasket 4″.

In a fourth embodiment of the discharge valve illustrated in FIG. 4, the parts of the discharge valve that are equivalent to parts of the discharge valve illustrated in FIG. 1 have the same reference numerals but with an added triple prime (‴). The sleeve and the gasket form one unit 47, which is freely inserted into a bore of the valve 5‴, whereby a certain clearance remains between the upper face of the unit 47 and the lower face of the valve 5‴.

Although the invention is illustrated and described with reference to a plurality of preferred embodiments thereof, it is to be expressly understood that it is in no way limited to the disclosure of such a plurality of embodiments, but is capable of numerous modifications within the scope of the appended claims.

What is claimed is:

1. A piston-type injection pump for supplying fuel through a discharge conduit to an injector of an internal combustion engine, the pump comprising, in combination a cylinder having a fuel supply port in a wall thereof, a piston supported for rotation and reciprocation in the cylinder to effect the pressure and suction strokes of the pump, the piston having a profiled peripheral edge cooperable with the fuel supply port in the cylinder during the piston movement for effecting a flow of fuel through the fuel supply port, the space between the piston and the associated end of the cylinder defining a first chamber; means associated with the cylinder and disposed downstream of the first chamber for defining a second chamber separated from but in fluid communication with the first chamber, said second chamber having upper, lower and side walls, a discharge channel, the downstream end of the second chamber communicating with the upstream end of the discharge channel; a relief piston being movably mounted in said second chamber between an upstream position in which the relief piston contacts the upper wall of said second chamber and a downstream position in which the relief piston is spaced a predetermined minimum distance from the lower wall of said second chamber, said side wall defining an annular space in said second chamber disposed between said relief piston and side wall, said side wall and relief piston defining a maximum flow-through area for the fuel therebetween when said relief piston is in said upstream position, said maximum flow-through area being substantially equal to the cross-sectional flow-through area of said discharge channel.

2. The pump as defined in claim 1, wherein said relief piston has at least a first annular recess and said side wall has an annular groove, both of which have upper and lower edges, the upper edge of one and the lower edge of the other of said annular spaces defining therebetween said maximum flow-through area.

3. The pump as defined in claim 2, wherein said relief piston has a transverse channel terminating in said first annular recess and a blind axial channel terminating in said transverse channel, said channels serving to communicate the discharge conduit with said annular space in said second chamber particularly when said relief piston is in said upstream position.

4. The pump as defined in claim 3, wherein said relief piston has a second annular recess which also has a transverse channel terminating therein and a blind axial channel extending from the lower face of said relief piston to said transverse channel.

5. The pump as defined in claim 1, wherein said means defining said second chamber include a valve body having a bore, a sleeve coaxially mounted in said bore, said side wall of said second chamber being formed by said sleeve, and a gasket having an aperture being disposed between said valve body and said cylinder.

6. The pump as defined in claim 5, wherein said sleeve and valve body form a unit, a clearance being provided between the lower end of said unit formed by said valve body and said sleeve and the upper face of said gasket.

7. The pump as defined in claim 5, wherein the lower face of said sleeve abuts against said gasket and protrudes slightly from the lower face of said valve body so that a clearance is present between the upper face of said gasket and the lower face of said valve body.

8. The pump as defined in claim 5, wherein said gasket and sleeve form a unit which is coaxially mounted in said bore of said valve body, there being a clearance between the lower face of said valve body and the upper face of said unit formed by said gasket and said sleeve.

* * * * *